US005252533A

United States Patent [19]

Yasuda et al.

[11] Patent Number: 5,252,533

[45] Date of Patent: Oct. 12, 1993

[54] THERMAL TRANSFER DYE IMAGE-RECEIVING SHEET

[75] Inventors: Kenji Yasuda, Yachiyo; Toshihiro Minato, Tokyo; Masaru Kato, Tokyo; Toshikazu Nagura, Tokyo; Hiroshi Arakawa, Tokyo, all of Japan

[73] Assignee: Oji Paper Co., Ltd., Tokyo, Japan

[21] Appl. No.: 856,796

[22] Filed: Mar. 24, 1992

Related U.S. Application Data

[63] Continuation-in-part of Ser. No. 553,301, Jul. 17, 1990, abandoned.

[30] Foreign Application Priority Data

| | | | |
|---|---|---|---|
| Jul. 18, 1989 | [JP] | Japan | 1-183634 |
| Jul. 25, 1989 | [JP] | Japan | 1-190634 |
| Aug. 10, 1989 | [JP] | Japan | 1-205718 |
| Nov. 15, 1989 | [JP] | Japan | 1-295090 |
| Nov. 16, 1989 | [JP] | Japan | 1-296050 |
| Nov. 28, 1989 | [JP] | Japan | 1-306410 |

[51] Int. Cl.[5] ..... B41M 5/035; B41M 5/38

[52] U.S. Cl. ..... 503/227; 428/195; 428/212; 428/213; 428/215; 428/216; 428/218; 428/413; 428/480; 428/483; 428/500; 428/913; 428/914

[58] Field of Search ..... 8/471; 428/195, 212, 428/913, 914, 213, 215, 216, 218, 413, 480, 483, 500; 503/227

[56] References Cited

U.S. PATENT DOCUMENTS

| | | | |
|---|---|---|---|
| 4,774,224 | 9/1988 | Campbell | 503/227 |
| 4,778,782 | 10/1988 | Ito et al. | 503/227 |
| 4,971,950 | 11/1990 | Kato et al. | 503/227 |

*Primary Examiner*—B. Hamilton Hess

*Attorney, Agent, or Firm*—Armstrong, Westerman, Hattori, McLeland & Naughton

[57] ABSTRACT

A thermal transfer dye image-receiving sheet capable of receiving clear, uniform colored images without a formation of curls and wrinkles therein, comprising (A) a substrate sheet composed of (a) core sheet having a Young's modulus $E_3$, (b) a front coated thermoplastic film layer having a thickness $T_1$ and a Young's modulus $E_1$, and (c) a back coated thermoplastic film layer having a thickness $T_2$ and a Young's modulus $E_2$, the $T_1$, $T_2$, $E_1$, $E_2$ and $E_3$ satisfying the following relationships (1) and (2):

$$T_2 \geqq T_1 \quad (1)$$

and $$E_3 \geqq 2E_1 \geqq 2E_2 \quad (2)$$

wherein $Y_1$, $Y_2$ and $Y_3$ are determined in accordance with ASTM D882-64T.

6 Claims, 1 Drawing Sheet

THERMAL TRANSFER DYE IMAGE-RECEIVING SHEET

CROSS REFERENCE TO RELATED APPLICATION

This application is a continuation-in-part of our application Ser. No. 07/553,301 filed on Jul. 17, 1990, now abandoned.

BACKGROUND OF THE INVENTION

1) Field of the Invention

The present invention relates to a thermal transfer dye image-receiving sheet. More particularly, the present invention relates to a thermal transfer dye image-receiving sheet capable of receiving and fixing thereon thermally transferred dye or ink images or pictures in a clear and sharp form without a thermal curling thereof, capable of recording thereon continuous tone full colored images or pictures at a high resolution and a high tone reproductivity, and optionally capable of preventing stains of the back surface of the dye image-receiving sheet, caused by a dye or ink.

2) Description of the Related Arts

It is known that new types of color printers, for example, relatively compact thermal printing systems having a thermal head, enable a printing of clear colored images or pictures by a thermal transfer of the colored images or pictures of a thermomelting ink or sublimating dye onto an image-receiving sheet, and there is great interest in the further development and utilization of these printing systems, especially the sublimating dye colored image or picture-thermal transfer printing systems.

In the operation of the sublimating dye image or picture-thermal transfer printing system, an image-receiving sheet having a polyester resin layer, on which the sublimated dye is easily dyed, is superimposed on an ink sheet comprising a support sheet consisting of a thin plastic sheet and a sublimating dye ink layer formed on a surface of the support sheet, in a manner such that the surface of the polyester resin layer of the image-receiving sheet comes into contact with the surface of the ink layer of the ink sheet, and the ink sheet is locally heated imagewise by a thermal head in accordance with electric signals corresponding to the images or pictures to be printed, to thermally transfer the ink images or pictures composed of the sublimated dye, and having a color density corresponding to the amount of heat applied to the ink sheet on the polyester resin layer of the image-receiving sheet.

It is also known that a support sheet comprising a sheet substrate and a coating layer formed by bonding a bi-axially oriented plastic film consisting of a mixture of an inorganic pigment and a polyolefin resin and having a multilayered structure to the sheet substrate surface enables thermal transfer image-receiving sheets to receive thermally transferred images or pictures having a high quality from a printing system having a thermal head.

In the image-receiving sheet for the sublimating dye thermal transfer printing system, the above-mentioned support sheet is coated with a thermal transfer image-receiving layer comprising, as a principal component, a polyester resin.

The record sheet or image-receiving sheet having the above-mentioned support sheet has an even thickness, a high softness, and a lower thermal conductivity than that of paper composed of cellulose fibers, and therefore, is advantageous in that images or pictures having a high uniformity and color density can be formed thereon. Nevertheless, where the coating layer in the support sheet is formed from a bi-axially oriented plastic film comprising, as a principal component, a polyolefin, for example, polypropylene resin, and having a multilayered structure, and ink or dye images or pictures are thermally transferred by heat from a thermal head to the polyester resin coating layer in the image-receiving sheet, the multilayer structured polyolefin resin coating film in the support sheet is heated by the thermal head so that a drawing stress held in the polyolefin resin coating film is released, and thus the polypropylene resin coating film layer shrinks. This shrinkage of the polyolefin resin coating layer causes the image-receiving sheet to be curled and a number of wrinkles to be formed thereon, so that the forwarding of the sheet in the printing system is hindered by the curls or wrinkles on the sheet and the resultant prints have a reduced commercial value.

To eliminate the above-mentioned disadvantages, a new type of support sheet was provided by coating two surfaces of a sheet substrate consisting of, for example, a paper sheet, and having a relatively small heat shrinkage with the multilayer-structured plastic coating films. This type of the support sheet effectively prevents the formation of wrinkles on the image-receiving sheet due to the heat shrinkage of the plastic coating films, but since two coating films having different heat shrinkages are laminated on a sheet substrate, and the thermal transfer operation is applied to one side surface of the image-receiving sheet, the image-receiving sheet is locally shrunk, and thus is naturally not free from curl-formation. Especially, in the sublimating dye thermal transfer printing system, a large quantity of heat is applied to the image-receiving sheet, and therefore, the abovementioned problems often occur on the image-receiving sheet.

The sublimating dye thermal transfer printing system is a mainstream printing system among small size non-impact full colored image-printing systems, and thus is often used as a printer for small size electronic cameras or video printers. Therefore, there is an urgent demand for the provision of a new type of thermal transfer image-receiving sheet which can form clear images or pictures thereon without a thermal deformation thereof, even when used for the sublimating dye thermal transfer printing system in which a large quantity of heat is applied to the image-receiving sheet.

When a paper sheet comprising a cellulose pulp is used as a substrate sheet, the resultant image-receiving sheet is disadvantageous in that the images or pictures formed thereon have fiber-shaped marks or patches due to the use of the substrate paper sheet or due to the uneven adhesion of the coating layers with the substrate paper sheet, and thus the reproductivity of images is lowered.

To eliminate the above-mentioned disadvantages, an attempt was made to lower the thermal shrinkage of the multilayer-structured plastic resin film by heat-treating. That is, the multilayer-structured film was continuously brought into contact with a heating roller or passed through a heating oven, whereby the residual drawing stress on the film is released and the thermal shrinkage of the film was lowered. Nevertheless, when the long film was continuously heated while moving the film in the longitudinal direction thereof, it was found that the film shrunk in the transversal direction thereof and wrinkles and slacks were created on the film. Also, the multilayer-structured film had a low thermal conductivity, and a long time was required for completing the heat treatment. Therefore, it is difficult to effectively and evenly carried out the heat treatment for a multilayer structured film, with a high reproductivity, and the resultant heat treated film often has an uneven rough surface thereof.

In another attempt, a drawn or undrawn film comprising a thermoplastic resin and having a low thermal shrinkage, for example, polyester, polyolefin or polyamide, was employed as a substrate sheet for a dye image-receiving sheet. Especially, an attempt was made to use, as a substrate sheet, a film comprising a polyethylene terephthalate resin which may be modified with a modifying agent or copolymerized with a comonomer, and having a high resistance to deformation, for example, stretching and bending, and a uniform thickness.

When the polyethylene terephthalate resin film per se is employed as a dye image-receiving sheet, this sheet is advantageous in that substantially no curl is generated on the sheet during the thermal transfer printing operation, and the resultant transferred images or pictures have a uniform shading and quality. Therefore, it is considered that, because an oriented film consisting of a mixture of a polyethylene terephthalate resin with a white filler (pigment) has a high whiteness and opacity, it is preferable as a dye image-receiving sheet capable of receiving the thermal transferred images in a clear and sharp form.

Nevertheless, it was found that the polyester resin film is disadvantageous in that it is costly, exhibits a poor sensitivity when receiving the transferred images, and accordingly, the received images have a low color density due to the high thermal conductivity thereof. Further, it has a poor reliability with regard to the smooth movement thereof in the printer, due to a high modulus of elasticity and a high resistance to deformation (bending) thereof, and therefore, the transferred images are sometimes display an uneven color density or shading and are not clearly defined.

In still another attempt, a new type of dye image-receiving layer was developed. For example, Japanese Unexamined Patent Publication (Kokai) No. 62-244696 discloses a phenyl-modified polyester resin, and Japanese Unexamined Patent Publication (Kokai) No. 63-7971 discloses a polyester resin modified with a phenyl radical-containing alcohol compound. These new types of modified polyester resins are soluble in an organic solvent and useful for forming a dye image-receiving layer having a superior capability of receiving thereon a large amount of clearly defined dye images at a high transfer speed, and having an enhanced storage durability or stability.

Nevertheless, the resultant dye image-receiving sheet having an organic solvent-soluble polymeric layer for receiving dye images and at least one thermoplastic resin layer exhibits a high electrification property, and thus is disadvantageous in that the dye-image receiving sheet has a poor reliability with regard to a smooth feeding, movement, and delivery thereof in a printer. Also when a plurality of the image-transferred sheets are superposed one on the other, and stored in this state, an undesirable electric charge is generated on the sheets due to friction therebetween. Therefore, the printed sheets are electrically adhered (blocked) to each other and scratched by the friction therebetween, and thus the commercial value thereof is reduced.

To prevent the above-mentioned disadvantages due to electrification, usually an anti-static agent is applied to at least one face of the dye image-receiving sheet or to at least one face of a dye sheet. Nevertheless, in the thermal transfer printer, a plurality of dye image-receiving sheets are fed one by one to the printing operation, and thus it is difficult to completely prevent the above sheet-feeding problem, caused by the electrification of the dye image-receiving sheet, by only the application of the anti-static agent. Also, the printed sheets are stored and employed over a long period of time, and therefore, to prevent an adhesion of dust to the printed sheets, the effect of the anti-static agent applied to the sheets must be maintained for a long time. Also, even where the anti-static treatment is applied to the dye image-receiving sheets, when the sheets are stored and employed under a high humidity condition, the anti-static effect is not effectively generated on the sheets, and thus the above sheet feeding problem often occurs.

Accordingly, there is a demand for the provision of a new type of thermal transfer dye image-receiving sheet which is resistant to an electrification thereof while stored and employed.

In the printing operation, a number of dye image-receiving sheets is stored in the superimposed form, one on the other, in the printer and fed one by one to a printing step. Therefore, the image-receiving surfaces of the sheets are sometimes scratched by the back surfaces of adjacent sheets, whereby the commercial value of the resultant prints is significantly lowered.

Accordingly, there is a demand for the provision of a dye image-receiving sheet in which the dye image-receiving surface is not damaged by an adjacent sheet.

SUMMARY OF THE INVENTION

An object of the present invention is to provide a thermal transfer dye image-receiving sheet applicable to various types of dye-thermal transfer printers, including a sublimating dye thermal transfer printing system, and capable of forming and fixing clear dye images or pictures thereon without undesirable curling and wrinkle-forming due to a local heating of the sheet.

Another object of the present invention is to provide a thermal transfer dye image-receiving sheet able to effectively record continuous tone full colored clear images or pictures thereon at a high resolution and reproductivity.

Still another object of the present invention is to provide a dye image-receiving sheet which can be smoothly fed to, moved through, and delivered from a printer, without an undesirable blocking and damaging thereof.

The above-mentioned objects can be attained by the thermal transfer dye image-receiving sheet of the present invention which comprises (A) a substrate sheet composed of:

(a) a core sheet comprising a thermoplastic resin, (b) a front coated film layer formed on a front surface of the core sheet, and comprising a thermoplastic-resin, and (c) a back coated film layer formed on a back surface of the core sheet, and comprising a thermoplastic resin; and (B) a dye image-receiving layer formed on the front coated film layer of the substrate sheet and comprising a synthetic resin capable of being dyed with dyes, the core sheet and the front and back coated film layers satisfying the following relationships (1) and (2):

$$T_2 \geqq T_1 \quad (1)$$

and $$E_3 \geqq 2E_1 \geqq 2E_2 \quad (2)$$

wherein $T_1$ represents a thickness of the front coated film layer, $T_2$ represents a thickness of the back coated film layer, $E_1$ represents a Young's modulus of the front coated film layer, $E_2$ represents a Young's modulus of the back coated film layer, and $E_3$ represents a Young's modulus of the core sheet, the Young's moduli $E_1$, $E_2$, and $E_3$ being determined in accordance with ASTM D882-64T.

DESCRIPTION OF THE PREFERRED EMBODIMENTS

Figure 1:
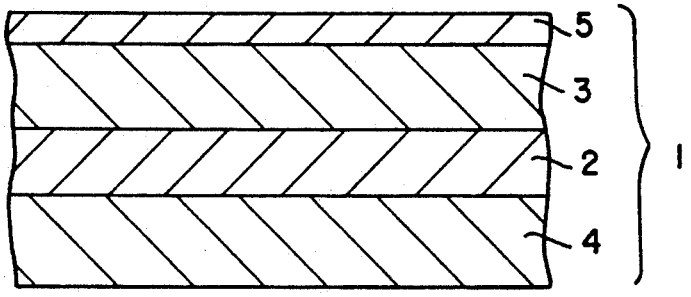
FIG. 1 is an explanatory cross-sectional view of an embodiment of the dye image-receiving sheet of the present invention.

In an embodiment of the dye image-receiving sheet of the present invention as shown in FIG. 1, a substrate sheet 1 is composed of a core sheet 2, a front coated film layer 3 formed on a front surface of the core sheet 2 and a back coated film layer 4 formed on a back surface of the core sheet 2, and a dye image-receiving layer 5 formed on the front coated film layer 3 to thereby form a laminated sheet.

Figure 2:
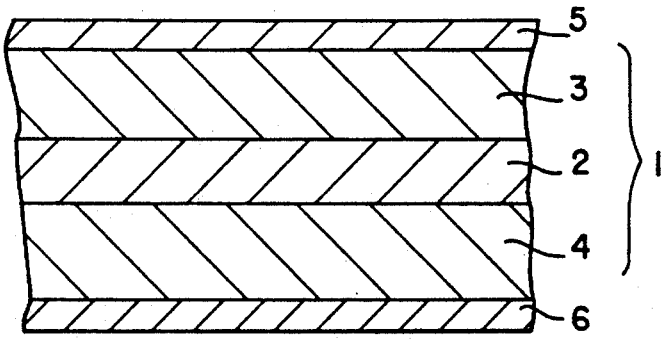
FIG. 2 is an explanatory cross-sectional view of another embodiment of the dye image-receiving sheet of the present invention.

In another embodiment of the dye image-receiving sheet of the present invention, as shown in FIG. 2, a dye image-receiving layer 5 is formed on the front surface of the substrate sheet 1 composed of a core sheet 2, a front coated film layer 3 and a back coated film layer 4, and a lining layer 6 formed on the back surface of the substrate sheet 1.

In the dye image-receiving sheet of the present invention, the substrate sheet is composed of a core sheet having a thickness $T_3$ and a Young's modulus of $E_3$, a front coated film layer, on which the dye image receiving layer is formed, having a thickness $T_1$ and a Young's modulus $E_1$, and a back coated film layer having a thickness $T_2$ and a Young's modulus $E_2$, and the thicknesses $T_1$ and $T_2$, and the Young's moduli $E_1$, $E_2$, and $E_3$ must satisfy the following relationships (1) and (2):

$$T_2 \geqq T_1 \quad (1)$$

and $$E_3 \geqq 2E_1 \geqq 2E_1 \quad (2)$$

All the Young's moduluses mentioned in the specification were determined in accordance with ASTMD-882-64T.

When the relationship (1) is satisfied, the mechanical properties of the front and back coated film layers are fully balanced with each other, and even if the core sheet has a high rigidity, the resultant substrate sheet can exhibit suitable mechanical properties, for example, flexibility or stiffness.

When the relationship (2) is satisfied, the resultant dye image-receiving sheet exhibits a satisfactory resistance to curl formation and a satisfactory rigidity.

When all of the relationships (1) and (2), are simultaneously satisfied, the resultant dye image-receiving sheet can receive and fix continuous tone full color clearly defined dye images or pictures thereon, at a high resolution and reproductivity and without a curl and wrinkle formation therein when a thermal transfer printing operation is applied thereto.

Usually, the front coated film layer preferably has a Young's modulus $E_1$, of 20 to 500 kg/mm$^2$, and a thickness $T_1$ of 10 μm of more, more preferably 20 to 160 μm.

Also, the back coated film layer preferably has a Young's modulus $E_2$ of 20 to 500 kg/mm$^2$, and a thickness $T_2$ of 10 μm or more, more preferably 20 to 160 μm.

There is no limitation to the thickness of the dye image-receiving sheet, but this thickness is preferably 200 μm or less.

In the dye image-receiving sheet of the present invention, there is no limitation to the thickness of the core sheet, but this thickness is preferably 4 μm or more. Also, the core sheet preferably has a basis weight of 5 to 150 g/m$^2$, more preferably 10 to 110 g/m$^2$, and a thermal shrinkage of 0.1% or less.

The core sheet preferably comprises a member selected from the group comprising of paper sheets, coated paper sheets, and synthetic resin films.

In the substrate sheet usable for the present invention, each of the front and back coated film layer comprises a thermoplastic resin, for example, a polyolefin resin. The thermoplastic resin is optionally mixed with an inorganic pigment.

The front coated film layer on which the dye image-receiving layer is formed preferably has a thermal shrinkage $Y_1$ equal to or smaller than that of the back coated film layer and equal to or more than twice that of the core sheet, preferably 0.8% or less.

Also, the front coated film layer preferably has a thickness $T_1$ of 30 to 100 μm, which is equal to or smaller than that of the back coated film layer.

In an embodiment of the dye image-receiving sheet of the present invention, the core sheet has a thickness of 4 to 80 μm, more preferably 10 to 50 μm, and comprises a synthetic resin film, and each of the front and back coated layers comprises a mixture of a polyolefin resin with an inorganic pigment and has a multilayered film structure having at least one biaxially oriented film base layer.

The synthetic resin film for the core sheet is preferably selected from polyester resin films, polyolefin resin films and polyamide resin films, more preferably polyethylene terephthalate resin films, modified polyethylene terephthalate resin films mixed with a modifying agent, and copolymerized polyethylene terephthalate resin films. Still more preferably, the core sheet comprises a mono- or biaxially oriented synthetic resin film having a high rigidity or resistance to deformation such as elongation or bending, and a high mechanical strength.

To enhance the bonding activity of both surfaces of the core sheet comprising a synthetic resin film, an anchor coating treatment is preferably applied to both surfaces of the core sheet.

Where the core sheet consists of a mono- or biaxially oriented polyethylene terephthalate film, this core sheet preferably has a thermal shrinkage of about 0% at a temperature of 100° C., and about 0.2% at a temperature of 120° C., whereas the biaxially oriented polypropylene film has a thermal shrinkage of about 3.5%. Also, the polyethylene terephthalate film has a Young's modulus of about 400 to 600 kg/mm$^2$ in the longitudinal or transverse direction thereof. The Young's modulus of the polyethylene terephthalate film in the longitudinal direction thereof is particularly higher than that of mono- or biaxially oriented polyolefic (especially polypropylene) resin film.

Nevertheless, if a synthetic resin film having a high rigidity, for example, the oriented polyethylene terephthalate film per se, is used as a dye image-receiving sheet, this sheet exhibits a high resistance to curl-formation, and the formation of uneven images due to an uneven inside structure of the image-receiving sheet is restricted.

Nevertheless, this type of dye image-receiving sheet is disadvantageous in that the price is too high, the dye image receiving sensitivity is poor, and accordingly, the received images are sometimes uneven, and the resistance to deformation is excessively high, and thus the movement of the sheet in the printer is not smooth and sometimes the received images become blurred.

In the above-mentioned embodiment of the substrate sheet usable for the present invention, the core sheet comprising a polyester resin film and having a thickness of 4 to 80 μm, has a significantly small thermal shrinkage in comparison with those of the front and back coated film layers each comprising a multilayer structured polyolefin resin film. Also, the core sheet has a higher flexural resistance than that of the front and back coated film layers, and therefore, the resultant substrate sheet exhibits a high resistance to a thermal deformation (curl and wrinkle—formation) thereof.

The polyolefin resin usable for the front and back coated film layers preferably comprises at least one member selected from polyethylene, polypropylene, polybutene, and polypentene resins and copolymer resins of two or more of the above-mentioned polymers. More preferably, the polyolefin resin comprises at least one member selected from high density polyethylene resins, low density polyethylene resins, polypropylene resins, and ethylene-propylene copolymer resins.

The inorganic pigment usable for the front and back coated film layers comprises at least one member selected from titanium dioxide, zinc sulfide, zinc oxide, light and heavy calcium carbonates, calcium sulfate, aluminum hydroxide, barium sulfate, clay, talc, kaolin, silica, and calcium silicate. The content of the inorganic pigment in the front or back coated film layer is preferably 1 to 65% based on the weight of the polyolefin resin.

The front and back surface coated films can be produced by the processes of U.S. Pat. Nos. 4,318,950 and 4,075,050.

The multilayered structure of the plastic film can be formed by laminating at least one bi-axially oriented base sheet comprising an polyolefin resin and an inorganic pigment, and at least two paper-like coated layers consisting of monoaxially drawn polyolefin films and bonded to the two surfaces of the base sheet to provide a composite film having a multilayer-structure, or by laminating at least one base sheet, at least two paper-like coated sheets and an additional layer, for example, an additional top-coated layer, to increase the whiteness of the resultant composite film having a multilayer structure.

The above-mentioned multilayer plastic films are known as synthetic paper-like sheets and used for printing and hand-writing. The synthetic paper-like sheets are disadvantageous in that they have an unsatisfactorily low stiffness and resilience, and a high heat shrinkage. To eliminate or reduce the above-mentioned disadvantages, the synthetic paper-like sheet is laminated with another paper-like sheet, or with a polyester film or a paper sheet, and then with another paper-like sheet.

An attempt was made to use the synthetic paper-like sheet per se as an image-receiving sheet for a sublimating dye thermal transfer printing system, to improve the quality of the thermal transferred images or pictures. This attempt, however, was not successful because the synthetic paper-like sheet exhibited a lower thermal resistance than that necessary for a practical thermal transfer image-receiving sheet, and thus, when used in the printing operation, the synthetic paper-like sheet was easily shrunk and curled.

Accordingly, in the image-receiving sheet of the present invention, the front and back coated film layers are supported by the core sheet.

The multilayer structured polyolefin film usable for the present invention preferably has a Young's modulus of 110 to 160 kg/mm$^2$ in the longitudinal direction thereof and of 250 to 280 kg/m$^2$ in the transverse direction thereof.

The thermal shrinkages of the front and back coated films and the core sheet can be controlled to a desired level by bringing the films or sheet into contact with a heating medium, for example, a heating roll or hot air, while maintaining the film or sheet in a relaxed condition under which the film or sheet can be thermally shrunk.

Also, the front and back coated multilayer structured polyolefin films preferably have a basis weight of 25 to 80 g/m$^2$ and a thickness of 30 to 100 μm.

The substrate sheet is coated on at least one surface thereof with the dye image-receiving layer.

If the thermal shrinkages of the front and back coated film layers are different from each other, the dye-receiving layer is preferably formed on one coated film layer having a lower thermal shrinkage than that of the other coated film layer.

The dye image-receiving layer comprises a thermoplastic resin material able to be dyed with sublimating dyes which are fixed therein. The sublimating dye-dyable thermoplastic resin material comprises at least one member selected from saturated polyester resins, polycarbonate resins, polyacrylic resins, and polyvinyl acetate resins.

The sublimating dye-dyeable polyester resin is a polycondensation product of dicarboxylic acid component with a dihydric alcohol component. The dicarboxylic acid component comprises at least one member selected from, for example, terephthalic acid, isophthalic acid, and sebacic acid. The dihydric alcohol component comprises at least one member selected from, for example, ethylene glycol, propylene glycol, neopentyl glycol, and aromatic diols, for example, an addition product of bisphenol A with ethylene oxide which is addition reacted with the two hydroxyl groups of the bisphenol A.

There is no specific restriction on the thickness and weight of the dye image-receiving layer, but usually the dye image-receiving layer preferably has a thickness of 2 to 20 μm, more preferably 4 to 17 μm, and a weight of 3 to 12 g/m$^2$, more preferably 4 to 9 g/m$^2$.

The image-receiving layer can be formed by coating a surface of the substrate sheet with a coating paste containing a sublimating dye-dyeable thermoplastic resin, for example, a saturated polyester resin available under a trademark of VYLON 200, from Toyobo Co., dissolved in an organic solvent, for example, toluene, and drying.

The dye image-receiving sheet of the present invention is optionally provided with a lining layer formed on the back coated film layer of the substrate sheet. The lining layer preferably comprises a synthetic resin, for example, an acrylic resin, surface active polymeric material or low molecular weight surface active material, and has a weight of 0.3 to 1.5 g/m$^2$.

The lining layer usually effectively prevents a close adhesion of the dye image-receiving sheets to each other.

In another embodiment of the dye image-receiving sheet of the present invention, the core sheet has a thickness of 20 to 200 μm, the front coated film layer comprises a mixture of a polyester resin with an inorganic pigment, and the dye image-receiving layer is formed on the front coated film layer.

In the above-mentioned embodiment of the dye image-receiving sheet of the present invention, the back surface of the core sheet is preferably coated with a back coated film layer comprising a mixture of a polyolefin resin with an inorganic pigment and having a multilayered film structure. In the above-mentioned embodiment, the core sheet preferably has a thermal shrinkage of 0.1% or less and comprises a fine paper sheet, a middle grade of paper sheet, a Japanese paper sheet, coated paper sheet, or a synthetic resin film, for example, a polyester film or polyamide film. Preferably, the core sheet comprises a coated paper sheet comprising a fine paper sheet substrate and a coated layer formed on the substrate and comprising a mixture of a pigment, for example, kaolin, clay, calcium carbonate, aluminum hydroxide, or a plastic pigment, with a binder comprising at least one member selected from water-soluble binders, for example, starch and polyvinylalcohol, and aqueous emulsions of a water-insoluble polymer, for example, styrene copolymer or polybutadiene. The coated paper sheet preferably has a basis weight of 50 to 200 g/m$^2$ and the layer is coated thereon in an amount of 4 to 40 g/m$^2$.

The front coated film layer comprising a polyester resin and an inorganic pigment preferably has a thermal shrinkage of 0.1% or less.

The polyester resin preferably comprises a polyethylene terephthalate, a mixture of polyethylene terephthalate with a small amount of another polyester resin or a polyethylene terephthalate copolymer, and the inorganic pigment comprises, for example, titanium dioxide or calcium carbonate and is in an amount of 1 to 65% based on the weight of the polyester resin. When formed from a mono- or bi-axially oriented polyester film, the resultant front coated film layer is relatively cheap, exhibits an appropriate mechanical strength and rigidity and a low elongation, and has a uniform thickness. Preferably, the front coated film layer has a weight of 5 to 70 g/m$^2$, a thickness of 4 to 80 μm, and a thermal shrinkage equal to or less than the thermal shrinkage of the back coated film layer.

The back coated film layer comprises a polyolefin resin, for example, a polyethylene, polypropylene, ethylene-propylene copolymer resins or a mixture of two or more of the above-mentioned resins, and an inorganic resin, for example, titanium dioxide or calcium carbonate, in an amount of 1 to 65% based on the weight of the polyolefin resin. Preferably, the thickness of the back coated film layer is smaller than the total thickness of the front coated film layer and the core sheet.

In another embodiment, the dye image-receiving sheet has a substrate sheet having a thickness of 20 to 200 μm and a dye image-receiving layer comprising a synthetic resin capable of being dyed with dyes and soluble in an organic solvent, and has been brought into contact with an air atmosphere having a relative humidity of 60% or more at room temperature for 10 seconds or more. In this embodiment, the dye image-receiving sheet is optionally provided with an anti-static lining layer formed on the back surface of the substrate sheet.

The above-mentioned surfaces of the dye image-receiving sheet exposed to the high humidity air atmosphere exhibit a low surface resistivity, and this low surface resistivity is maintained at a satisfactory level for a long time. Therefore, this type of dye image-receiving sheet can be smoothly printed by a thermal transfer printer without a misfeeding and blocking thereof, and does not allow a static electrical collection of dust thereon.

The anti-static lining layer preferably contains a mixture of a water-soluble cationic polymer material, with an acrylic polymer material. These polymeric materials may be cross-lined with a cross-linking agent, for example, an epoxy resin, melamine-formaldehyde resin, zinc oxide or basic aluminum compound. The cross-linked lining layer has an enhanced water resistance, organic solvent resistance, and mechanical strength.

The water-soluble cationic polymeric material includes polyethyleneimine, cationic monomer-copolymerized acrylic resins, and cationically modified acrylamide polymers.

The lining layer preferably contains 10 to 100% by weight, more preferably 20 to 40% by weight, of a water-soluble anti-static material.

Also, the dye image-receiving layer preferably contains 0.01 to 10% by weight, more preferably 0.1 to 2% by weight, of a solvent-soluble anti-static agent.

The dye image-receiving layer and the optional anti-static lining layer exposed to the high humidity air atmosphere preferably has a surface resistivity of $10^{11}$ Ω-cm or less, more preferably $10^{10}$ Ω-cm or less, at a temperature of 20° C. and at a relative humidity (RH) of 65%.

In another embodiment of the dye image-receiving sheet of the present invention, the back coated film layer is coated with a lubricant layer comprising a mixture of a reaction product of an epoxy resin with an acrylic polymer having at least one type of group reactive with the epoxy resin with a water-soluble cationic polymeric material, and having a surface resistivity of $10^{11}$ Ω-cm or less, preferably $10^{10}$ Ω-cm or less.

The lubricant layer effectively accelerates the attenuation of static electricity generated on the dye image-receiving sheet and prevents the electrification of the dye image-receiving sheet. This feature effectively ensures a smooth conveyance of the dye image-receiving sheet travel through the printer, without a misfeeding or blocking thereof, and prevents staining of the back faces of the printed sheets with dyes or ink due to friction between the printed sheets, re-sublimation or thermal diffusion of the dyes.

The epoxy resin usable for the present invention is selected from, for example, bisphenol A epoxy resins, straight chain type epoxy resins, methyl-substituted epoxy resins, side chain type epoxy resins, novolak type epoxy resins, phenol novolak type epoxy resins, cresol type epoxy resins, polyphenol type epoxy resins, aliphatic epoxy resins, aromatic epoxy resins ether ester type epoxy resins, and cyclo-aliphatic epoxy resins.

The acrylic polymer reactive with the epoxy resin is selected from a polymerization product of at least one member selected from, for example, methyl methacrylate, ethyl methacrylate, propyl methacrylate, butyl methacrylate, isobutyl methacrylate, tert-butyl methacrylate, 2-ethylhexyl methacrylate, octyl methacrylate, isodecyl methacrylate, lauryl methacrylate, lauryltridecyl methacrylate, tridecyl methacrylate, cetylstearyl methacrylate, stearyl methacrylate, cyclohexyl methacrylate, benzyl methacrylate, methacrylic acid, 2-hydroxyethyl methacrylate, 2-hydroxy-propyl methacrylate, dimethylaminoethyl methacrylate, diethylaminoethyl methacrylate, glycidyl methacrylate, tetrahydrofurfuryl methacrylate, ethylene dimethacrylate, diethyleneglycol dimethacrylate, triethyleneglycol dimethacrylate, and allyl dimethacrylate. The reactive group in the acrylic polymer includes, for example, an aminoradical, carboxyl radical, hydroxyl radical, phenolic hydroxyl radical, and acid anhydride radical. These reactive groups can be introduced into the acrylic polymers by copolymerizing an acrylic monomer with an amino-containing monomer for example, dimethylaminoethyl methacrylate, vinyl pyridine or tert-butyl aminoethyl methacrylate; a carboxyl-containing monomer, for example, acrylic acid, methacrylic acid, crotonic acid, itaconic acid, maleic acid, itaconic acid half-ester or maleic acid half-ester; a hydroxyl-containing monomer, for example, allylalcohol, 2-hydroxyethyl methacrylate, 2-hydroxyethyl acrylate, 2-hydroxypropyl methacrylate, 2-hydroxypropyl acrylate, or polyhydric alcohol-monoacrylethel; or an acid anhydride-containing monomer, for example, itaconic anhydride or maleic anhydride.

The acrylic polymer resins preferably have an MFT of 50° C. or more and a $T_g$ of 20° C. or more, and form a coated membrane having a high transparency, glossiness, and bonding strength to the substrate sheet, and a satisfactory blocking resistance.

In the reaction of the epoxy resin with the acrylic polymer, there is no limitation to the mixing ratio of the epoxy resin to the acrylic polymer, but preferably the epoxy resin is reacted in an amount of 1 to 30 parts by weight to 100 parts by weight of the acrylic polymer.

The water-soluble cationic polymeric material usable for the present invention is selected from, for example, the above-mentioned materials, and employed preferably in an amount of 10 to 50 parts by weight, more preferably 20 to 40 parts by weight, based on 100 parts by weight of the acrylic polymer.

The lubricant layer can be formed in the same manner as that applied for the dye image-receiving layer.

In the other embodiment of the dye image-receiving layer of the present invention, the core sheet has a density of 0.75 to 1.6, the front coated film layer comprises a polyethylene terephthalate resin and has a density of 0.45 to 1.05, and the dye image-receiving layer is formed on the front coated film layer and has a thickness of 2 to 20 μm.

The core sheet comprises a member selected from, for example, fine paper sheets, middle grade paper sheets, Japanese paper sheets, coated paper sheets, polyester resin films and polyamide resin films, which have a density of 0.75 to 1.6 and preferably a thermal shrinkage of 0.5% or less, more preferably 0.1% or less.

The front coated film layer comprises a polyethylene terephthalate resin film having a density of 0.45 to 1.05, preferably 0.45 to 0.9, and preferably a thickness of 15 to 80 μm and a small thermal shrinkage corresponding to not more than a half of that of the back coated film layer.

Preferably, the front coated film layer contains a number of voids which cause the front coated film layer to become opaque, and the colored images received on the resultant dye image-receiving sheet to be clearly defined.

EXAMPLES

The present invention will be further explained with reference to the following examples.

In the examples, the dye image-receiving properties and the thermal curling property of the resultant dye image-receiving sheets were tested and evaluated in the following manner.

The dye image-receiving sheets were subjected to a printing operation using a sublimating dye thermal transfer printer available under the trademark of Video Printer VY-50, from HITACHI SEISAKUSHO.

In the sublimating dye thermal transfer printer, yellow, magenta and cyan dye ink sheets each composed of a substrate consisting of a polyester film having a thickness of a 6 μm and a wax-colored ink coating layer formed on a surface of the substrate and containing 50% by weight of a filler consisting of carbon black were used. A thermal head of the printer was heated stepwise at a predetermined heat quantity, and the heat-transferred images were formed in a single color or a mixed (superposed) color provided by superposing yellow, magenta and cyan colored images, on the test sheet.

In each printing operation, the clarity (sharpness) of the images, the evenness of shading of the dots, the evenness of shading of close-printed portions, and the resistance of the sheet to thermal curling were observed by the naked eye, and evaluated as follows:

| Class | Evaluation |
|---|---|
| 5 | Excellent |
| 4 | Good |
| 3 | Satisfactory |
| 2 | Not satisfactory |
| 1 | Bad |

Also, the image-receiving sheets were heated at a temperature of 120° C. for 10 minutes and kept standing at room temperature, and the resistance of the sheet to thermal curling was observed by the naked eye and evaluated in the same manner as mentioned above.

All the thermal shrinkages mentioned in the examples were determined in accordance with the test method set forth in Japanese Industrial Standard (JIS) K6734-1975, 6.6; Heat Shrinkage Test.

In this test method, a test piece is placed horizontally in a tester, heated at a temperature of 100°±2° C. for 10 minutes, and then cooled to room temperature. The thermal shrinkage of the test piece is calculated in accordance with the equation:

$$Y = \frac{l_2 - l_1}{l_1} \times 100$$

wherein Y represents the thermal shrinkage in % of the test piece, $l_1$ represents a gauge length of the test piece before heating, and $l_2$ represents a gauge length of the test piece after heating.

EXAMPLE 1

A polyethylene terephthalate film available under the trademark of Lumiler S38 from Toray Inc. and having a basis weight of 53 g/m$^2$, a thickness of 38 μm and a Young's modulus of 400 kg/mm$^2$, was used as a core sheet.

A mono- and bi-axially oriented multilayer structured film available under the trademark of Yupo FPG50 from Oji Yuka Goseishi K. K., comprising a mixture of a polyolefin resin with an inorganic pigment and having a thickness of 50 μm and a Young's modulus of 140 kg/mm$^2$, was used to form a front coated film layer.

A mono- and bi-axially oriented multilayer structured film available under the trademark of Yupo FPG60 from Oji Yuka Goseishi K. K., comprising a mixture of a polyolefin resin with an inorganic pigment and having a thickness of 60 μm and a Young's modulus of 121 kg/mm$^2$, was used to form a back-coated film layer.

The above-mentioned films were bonded respectively to the front and back surfaces of the core sheet by a dry laminate bonding method using a polyester binder, to provide a substrate sheet.

A coating liquid having the following composition was prepared for the dye image-receiving layer.

| Component | Amount (part by weight) |
|---|---|
| Polyester resin $(*)_1$ | 100 |
| Amino-modified silicone $(*)_2$ | 2 |
| Epoxy-modified silicone $(*)_3$ | 2 |
| Solvent-soluble cationic acrylic resin $(*)_4$ | 0.5 |
| Toluene | 200 |
| Methylethyl ketone | 200 |

Note:
$(*)_1$ . . . Available under the trademark of Vylon 200, from Toyobo Co.
$(*)_2$ . . . Available under the trademark of Silicone KF-393, from Shinetsu Silicone Co.
$(*)_3$ . . . Available under the trademark of Silicone X-22-343, from Shinetsu Silicone Co.
$(*)_4$ . . . Available under the trademark of Acrylic resin ST-2000, from Mitsubishi Yuka K. K.

The coating liquid was applied onto the front coated film layer surface of the substrate sheet and dried, to form a dye image-receiving layer having a dry weight of 5 g/m$^2$.

Accordingly, sublimating dye thermal transfer image-receiving sheet was provided, and this dye image-receiving sheet was subjected to the above-mentioned printing and heating tests. The results of the tests are shown in Table 1.

EXAMPLE 2

The same procedures as in Example 1 were carried out with the following exceptions.

The front coated film layer was formed from the same multilayer-structed film as used for the back-coated film layer of Example 1.

The back coated film layer was formed from a mono- and bi-axially oriented multilayer structured film available under the trademark of Yupo FPG 80 from Oji Yuka Goseishi K. K., comprising a mixture of a polyolefin resin with an inorganic pigment and having a thickness of 80 μm and a Young's modulus of 121 kg/mm$^2$.

The test results are shown in Table 1.

EXAMPLE 3

The same procedures as in Example 1 were carried out except that the core sheet was composed of a polyethylene terephthalate film available under the trademark of Lumiler S25 from Toray Inc. and having a thermal shrinkage of 0% in the longitudinal direction thereof, and a thickness of 25 μm.

The multilayer structured polyolefin film Yupo FPG80 was heat treated to adjust the thermal shrinkage thereof to a level of 0.2% in the longitudinal direction thereof. This heat treated film was coated on the front surface of the core sheet, to form a front coated film layer.

The same heat treated multilayer structured polyolefin film Yupo FPG80 as mentioned above and having a thermal shrinkage of 0.2% in the longitudinal direction thereof was coated on the back surface of the core sheet, to form a back coated film layer.

The Young's moduli, thicknesses, and bulk densities of the core sheet and the front and back coated film layers are shown in Table 2.

The test results are sown in Table 1.

EXAMPLE 4

The same procedures as in Example 1 were carried out, with the following exceptions.

The same multilayer structured polyolefin film Yupo FPG60 as mentioned in Example 1 and having a thermal shrinkage of 0.5% in the longitudinal direction thereof was heat treated to adjust the thermal shrinkage thereof to a level of 0.2% in the longitudinal direction thereof, and the resultant heat treated film was coated on the front surface of the core sheet.

The non-heat treated multilayer structured polyolefin film Yupo SGG 60, having a thermal shrinkage of 0.6% was coated on the back surface of the core sheet.

The Young's moduli, thicknesses, and the bulk densities of the core sheet and the front and back coated film layers are shown in Table 2.

The test results are shown in Table 1.

COMPARATIVE EXAMPLE 1

The same procedures as in Example 1 were carried out, with the following exceptions.

The core sheet was composed of a bi-axially oriented polypropylene film available under the trademark of Torayphane BD#40 from Toray Inc., and having a thickness of 40 μm, and a thermal shrinkage of 0.4% in the longitudinal direction thereof.

The Young's moduli, thicknesses, and bulk densities of the core sheet and the front and back coated film layers are shown in Table 2.

The test results are shown in Table 1.

COMPARATIVE EXAMPLE 2

The same procedures as in Example 1 were carried out, except that the core sheet was composed of a bi-axially oriented polypropylene film available under the trademark of Torayphane BO#60 from Toray Inc. and having a thickness of 60 μm and a thermal shrinkage of 0.6%, and the front and back coated film layers were formed from the same mono- and bi-axially oriented multilayer film, Yupo FPG60, as mentioned in Example 1.

The Young's moduli, thicknesses, and bulk densities of the core sheet and the front and back coated film layers are shown in Table 2.

The test results are shown in Table 1.

COMPARATIVE EXAMPLE 3

The same procedures in Example 1 were carried out, except that the substrate sheet was composed of a multilayer structured polyolefin film Yupo FPG200 alone.

The Young's moduli, thicknesses, and bulk densities of the core sheet and the front and back coated film layers are shown in Table 2.

The test results are shown in Table 1.

COMPARATIVE EXAMPLE 4

The same procedures as in Example 1 were carried out, with the following exceptions.

The front coated film layer was formed from the multilayer structured film Yupo FPG60.

The back coated film layer was formed from the multilayer structured film Yupo FPG50.

The test results are shown in Table 1.

COMPARATIVE EXAMPLE 5

The same procedure as in Example 1 were carried out, with the following exceptions.

The front coated film layer was formed from the multilayer structured film Yupo FPG80.

The back coated film layer was formed from the multilayer structured, film Yupo FPG60.

The test results are shown in Table 1.

TABLE 1

| Example No. | | Item: Colored image: Clarity | Colored image: Uniformity | Resistance to curling: Printing test | Resistance to curling: Heating test |
|---|---|---|---|---|---|
| Example | 1 | 5 | 5 | 5 | 5 |
| | 2 | 5 | 5 | 4 | 4 |
| | 3 | 5 | 5 | 5 | 5 |
| | 4 | 5 | 4 | 4 | 4 |
| Comparative Example | 1 | 4 | 3 | 5 | 5 |
| | 2 | 5 | 5 | 2 | 2 |
| | 3 | 5 | 5 | 1 | 1 |
| | 4 | 3 | 5 | 1 | 1 |
| | 5 | 3 | 5 | 1 | 1 |

TABLE 2

| Item | | Example No. Example 3 | Example 4 | Comparative Example 1 | 2 | 3 |
|---|---|---|---|---|---|---|
| Front coated film layer | $E_1$ | 121 | 121 | 140 | 121 | — |
| | $D_1$ | 0.77 | 0.79 | 0.77 | 0.77 | — |
| | $T_1$ | 80 | 60 | 50 | 60 | |
| Back coated film layer | $E_2$ | 121 | 121 | 121 | 121 | — |
| | $D_2$ | 0.77 | 0.79 | 0.77 | 0.77 | — |
| | $T_2$ | 80 | 60 | 60 | 60 | — |
| Core sheet | $E_3$ | 400 | 400 | 180 | 180 | 130 |
| | $D_3$ | 1.4 | 1.4 | 0.91 | 0.91 | 0.7 |
| | $T_3$ | 25 | 38 | 40 | 60 | 200 |

Note:
$E_1$, $E_2$, $E_3$ . . . in kg/mm$^2$
$T_1$, $T_2$, $T_3$ . . . in μm

EXAMPLE 5

The same procedure as in Example 1 were carried out, with the following exceptions.

The front coated film layer was formed from a white polyethylene terephthalate film having a thickness of 50 μm, a Young's modulus of 250 kg/mm$^2$ and a density of 0.85 g/cm$^2$, and available under the trademark of W901E from Diafoil K.K.

The core sheet consisted of a white polyethylene terephthalate film having a thickness of 25 μm, a Young's modulus of 540 kg/mm$^2$ and a density of 1.48 g/cm$^2$, and available under the trademark of U2 from Teijin Ltd.

The test results are shown in Table 3.

COMPARATIVE EXAMPLE 6

The same procedures as in Example 5 were carried out, with the following exceptions.

The front coated film layer was formed from the same polyethylene terephathalate film U2, as used for the core sheet in Example 5.

The core sheet consisted of the same polyethylene terephthalate film W901 as used for the front coated film layer in Example 5.

The test results are shown in Table 3.

COMPARATIVE EXAMPLE 7

The same procedures as in Example 1 were carried out, with the following exceptions.

The front coated film layer was formed from a white polyethylene terephthalate film having a thickness of 75 μm, a Young's modulus of 550 kg/mm$^2$ and a density of 1.48 g/cm$^2$.

The core sheet consisted of the same polyethylene terephthalate film W901E as used for the front coated film layer.

The back coated film layer was formed from the same multilayer structured film Yupo 50 as mentioned in Example 1.

The test results are shown in Table 3.

TABLE 3

| Example No. | | Item: Colored image: Clarity | Colored image: Uniformity | Curl resistance (printing test) |
|---|---|---|---|---|
| Example | 5 | 5 | 5 | 5 |
| Comparative Example | 6 | 5 | 4 | 3 |
| | 7 | 5 | 4 | 2 |

EXAMPLE 6

The same procedures as in Example 1 were carried out, with the following exceptions.

The back surface of the substrate sheet was coated with a coating liquid having the following composition, to provide an anti-static lining layer.

| Component | Part by wt. |
|---|---|
| Acrylic acid ester copolymer (*)$_5$ | 100 |
| Epoxy resin (*)$_6$ | 5 |
| Water-soluble anti-static agent (*)$_7$ | 20 |
| Methyl alcohol | 100 |
| Water | 200 |

Note:
(*)$_5$ . . . Available under the trademark of Primal WL-81, from Rohm and Haas
(*)$_6$ . . . Available under the trademark of Epocoat DX-255, from Schell Chemical Co.
(*)$_7$ . . . Available under the trademark of Saftomer ST-3100, from Mitsubishi Yuka K. K.

Also, the front surface of the substrate sheet was coated with a coating liquid having the following composition, to form a dye image-receiving layer.

| Component | Part by wt. |
|---|---|
| Polyester resin (Vylon 200) | 100 |
| Amino-modified silicone (KF-393) | 2 |
| Epoxy-modified silicone (X-22-343) | 2 |
| Toluene | 200 |
| Methylethyl ketone | 200 |

The resultant dye image-receiving sheet was exposed to an air atmosphere having a relative humidity of 80% at room temperature for 10 seconds, and the moisture conditioned sheet was hermetically sealed within a moisture-proofing aluminum foil package.

The surface resistivities of the front surface and the back surface of the moisture-conditioned dye image-receiving sheet were measured by using a Surface Resistivity Tester (trademark: Hiresta Model HT-210, made by Mitsubishi Yuka K.K.) immediately after opening the package and after the moisture conditioning treatment at a temperature of 20° C. at a relative humidity of 65% until reaching equilibrium. The same tests were applied to a non-moisture-conditioned dye image-receiving sheet packaged at a relative humidity of 25% at room temperature.

The test results are shown in Tables 4, 5 and 6.

EXAMPLE 7

The same procedures as in Example 6 were carried out with the following exceptions.

The core sheet consisted of a fine paper sheet having a basis weight of 64 g/m$^2$, a thickness of 55 μm, and a longitudinal thermal shrinkage of 0.01%.

The back coated film layer was formed from the multilayer structured polyolefin film Yupo FPG60 having a thickness of 60 μm and a longitudinal thermal shrinkage of 0.5%, by a dry laminating method using a polyester binder.

The front coated film layer was formed from a polyethylene terephthalate film available under the trademark of Lumilar T from Toray Inc. and having a thickness of 50 μm and a longitudinal thermal shrinkage of 0.02% by the same dry laminating method as mentioned above.

The test results are shown in Tables, 4, 5 and 6.

EXAMPLE 8

The same procedures as in Example 6 were carried out, except that the dye image-receiving layer was formed from the same coating liquid as that mentioned in Example 1.

The test results are shown in Tables 4, 5, and 6.

TABLE 4

| | Item | | | |
|---|---|---|---|---|
| | Surface resistivity (Ω-cm) immediately after opening package | | | |
| | Moisture conditioned sheet | | Non-moisture conditioned sheet | |
| Example No. | Back surface | Front surface | Back surface | Front surface |
| 6 | $1.6 \times 10^8$ | $8.2 \times 10^{10}$ | $1.4 \times 10^9$ | $1.2 \times 10^{12}$ |
| 7 | $1.9 \times 10^8$ | $9.3 \times 10^{10}$ | $1.8 \times 10^9$ | $7.1 \times 10^{11}$ |
| 8 | $2.0 \times 10^8$ | $2.0 \times 10^9$ | $5.6 \times 10^8$ | $9.5 \times 10^{10}$ |

TABLE 5

| | Item | | | |
|---|---|---|---|---|
| | Surface resistivity (Ω-cm) after moisture-equilibration | | | |
| | Moisture conditioned sheet | | Non-moisture conditioned sheet | |
| Example No. | Back surface | Front surface | Back surface | Front surface |
| 6 | $8.2 \times 10^7$ | $7.0 \times 10^{10}$ | $8.2 \times 10^7$ | $7.0 \times 10^{10}$ |
| 7 | $9.4 \times 10^7$ | $9.5 \times 10^{10}$ | $9.4 \times 10^7$ | $9.5 \times 10^{10}$ |
| 8 | $1.0 \times 10^7$ | $9.0 \times 10^8$ | $1.0 \times 10^7$ | $4.8 \times 10^9$ |

TABLE 6

| | Item | | | |
|---|---|---|---|---|
| Example No. | Colored image | | Anti-static property | Curling resistance (Printing test) |
| | Clarity | Uniformity | | |
| 6 | 5 | 5 | 4 | 3 |
| 7 | 4 | 4 | 4 | 5 |
| 8 | 5 | 5 | 5 | 3 |

EXAMPLES 9–13

In Example 9, the same procedures as in Example 1 were carried out, with the following exceptions.

The front surface of the substrate sheet was coated with a coating paste having the following composition.

| Component | Part by wt. |
|---|---|
| Polyester resin (Vylon 200) | 100 |
| Polyester silicone varnish $(*)_{10}$ | 5 |
| Toluene | 200 |
| Methylethyl ketone | 200 |

Note:
$(*)_{10}$ . . . Available under the trademark of Silicone Varnish KR-5203, from Shinetsu Silicon Co.

A dye image-receiving layer having a weight of 5 g/m$^2$ was formed.

The back surface of the substrate sheet was coated with a coating liquid having the following composition, to provide an anti-static lubricant layer having a dry weight of 1 g/m$^2$.

| Component | Part by wt. |
|---|---|
| Acrylic ester resin $(*)_{11}$ | 100 |
| Epoxy resin (Epocoat DX-255) | 5 |
| Water-soluble cationic polymer $(*)_{12}$ | 20 |
| Methyl alcohol | 100 |
| Water | 200 |

Note:
$(*)_{11}$ . . . Available under the trademark of Primal C-72, from Rohm and Haas
$(*)_{12}$ . . . Available under the trademark of Saftomer ST-1000, from Mitsubishi Yuka K. K.

The resultant dye image-receiving sheet had a total thickness of 151 μm and the lubricant layer exhibited a surface resistivity of $8.2 \times 10^7$ Ω-cm.

When the anti-static lubricant layer was not formed, the back coated film layer had a surface resistivity of $2.3 \times 10^{11}$ Ω-cm.

In Example 10, the same procedures as in Example 9 were carried out, except that the coating liquid had the composition shown below. The resultant lubricant layer had a surface resistivity of $8.2 \times 10^8$ Ω-cm.

| Component | Part by wt. |
|---|---|
| Acrylic ester resin (Primal WL-81) | 100 |
| Epoxy resin (Epocoat DX-255) | 5 |
| Water-soluble anionic polymer (*)13 | 20 |
| Methyl alcohol | 100 |
| Water | 200 |

Note:
(*)13 . . . Trademark: VERSA-TL125, made by Kanebo NSC K. K.

In Example 11, the same procedures as in Example 9 were carried out except that the coating liquid had the composition shown below. The resulting lubricant layer had a surface resistivity of $3.5\times10^8$ Ω-cm.

| Composition | Part by wt. |
|---|---|
| Acrylic ester resin (Primal WL-81) | 100 |
| Water-soluble cationic polymer (VERSA-TL125) | 5 |
| Methyl alcohol | 100 |
| Water | 200 |

In Example 12, the same procedures as in Example 9 were carried out, except that the coating liquid had the composition as shown below. The resultant lubricant layer exhibited a surface resistivity of $8.5\times10^7$ Ω-cm.

| Component | Part by wt. |
|---|---|
| Acrylic ester resin (Primal C-72) | 100 |
| Water-soluble cationic polymer (ST-1000) | 5 |
| Methyl alcohol | 100 |
| Water | 200 |

In Example 13, the same procedures as in Example 9 were carried out, with the following exceptions. The coating liquid had the composition as shown below. The resultant lubricant layer had a surface resistivity of $8.2\times10^{10}$ Ω-cm.

| Component | Part by wt. |
|---|---|
| Acrylic ester resin (Primal WL-81) | 100 |
| Epoxy resin (Epocoat DX-255) | 5 |
| Methyl alcohol | 100 |
| Water | 200 |

In each of Examples 9 to 13, the resultant dye image-receiving sheet was subjected to the printing tests mentioned above.

After the printing test, a number of printed sheets were superimposed one on the other in such a manner that each printed surface came into close contact with a lubricant layer surface of the adjacent sheet, under a load of 1 kg/m² and in a heating oven at a temperature of 60° C., for 10 days. The transfer of the colored images from the printed surface to the lubricant layer surface was observed and evaluated by the naked eye. Also, the resistance of the printed sheet to scratching was evaluated in the same manner as mentioned above.

The test results are shown in Table 7.

TABLE 7

| Example No. | Item: Surface resistivity (Ω-cm) of lubricant layer (20° C., 65% RH) | Resistance to scratching | Resistance to transfer of printed image |
|---|---|---|---|
| 9 | $8.2\times10^7$ | 5 | 5 |
| 10 | $8.2\times10^8$ | 5 | 5 |
| 11 | $3.5\times10^8$ | 3 | 2 |
| 12 | $8.5\times10^7$ | 3 | 2 |
| 13 | $8.2\times10^{10}$ | 5 | 5 |

We claim:

1. A thermal transfer dye image-receiving sheet comprising:
   (A) a substrate sheet composed of:
      (a) a core sheet comprising a thermoplastic resin,
      (b) a front coated film layer formed on a front surface of the core sheet, and comprising a mixture of a polyester resin and an inorganic pigment, and
      (c) a back coated film layer formed on a back surface of the core sheet, and having a multilayered structure composed of a plurality of mono- or bi-axially oriented film layers and comprising a mixture of a polyolefin resin with an organic pigment; and
   (B) a dye image-receiving layer formed on the front coated film layer of the substrate sheet and comprising a synthetic resin capable of being dyed with dyes;
   said core sheet and front and back coated film layers satisfying the following relationships (1) and (2):

$$T_2 \geqq T_1 \quad (1)$$

and $$E_3 \geqq 2E_1 \geqq 2E_2 \quad (2)$$

wherein $T_1$ represents a thickness of the front coated film layer, $T_2$ represents a thickness of the back coating film layer, $E_1$ represents a Young's modulus of the front coated film layer, $E_2$ represents a Young's modulus of the back coated film layer, and $E_3$ represents a Young's modulus of the core sheet, the Young's moduli $E_1$, $E_2$, and $E_3$ being determined in accordance with ASTM D882-64T.

2. The dye image-receiving sheet as claimed in claim 1, wherein the core sheet has a thickness of 4 to 80 μm and comprises a synthetic resin, and each of the front and back coated film layers comprises a mixture of a polyolefin resin with an inorganic pigment and has a multilayered film structure having at least one biaxially oriented film base layer.

3. The dye image-receiving sheet as claimed in claim 1, wherein each of the front and back coated film layers has a thickness of 30 to 100 μm.

4. The dye image-receiving sheet as claimed in claim 1, wherein the dye image-receiving layer comprises a synthetic resin capable of being dyed with dyes and soluble in an organic solvent, and both surface of the dye image-receiving sheet have been brought into contact with an air atmosphere having a relative humidity (RH) of 60% or more at room temperature, for 10 seconds or more.

5. The dye image-receiving sheet as claimed in claim 1, wherein the back coated film layer is coated with a lubricant layer comprising a mixture of a reaction product of an epoxy resin with an acrylic polymer having at least one type of group reactive with the epoxy resin with a water-soluble cationic polymeric material, and having a surface resistivity of $10^{11}$ Ω·cm or less.

6. The dye image-receiving sheet as claimed in claim 1, wherein the core sheet has a density of 0.75 to 1.6, the front coated film layer comprises a polyethylene terephthalate resin and has a density of 0.45 to 1.05, and the dye image-receiving layer has a thickness of 2 to 20 μm.

* * * * *